US012115464B2

(12) United States Patent
Zhou

(10) Patent No.: US 12,115,464 B2
(45) Date of Patent: Oct. 15, 2024

(54) INFLATABLE COSTUME

(71) Applicant: Shenzhen Xinbenchuang Electronics Co., Ltd., Shenzhen (CN)

(72) Inventor: Zanzan Zhou, Shenzhen (CN)

(73) Assignee: Shenzhen Xinbenchuang Electronics Co., Ltd., Shenzhen (CN)

( * ) Notice: Subject to any disclaimer, the term of this patent is extended or adjusted under 35 U.S.C. 154(b) by 0 days.

(21) Appl. No.: 18/430,674

(22) Filed: Feb. 2, 2024

(65) Prior Publication Data

US 2024/0165532 A1 May 23, 2024

(30) Foreign Application Priority Data

Jan. 5, 2024 (CN) ..... 202420026940.7

(51) Int. Cl.
*A63J 7/00* (2006.01)
*A41D 13/02* (2006.01)

(52) U.S. Cl.
CPC ..... *A63J 7/005* (2013.01)

(58) Field of Classification Search
CPC ..... A63J 7/005; A41D 13/012; A41D 13/02; A41D 15/00; A41D 2400/14; A01K 13/006
USPC ..... 472/57, 70, 134
See application file for complete search history.

(56) References Cited

U.S. PATENT DOCUMENTS

| | | | | |
|---|---|---|---|---|
| 1,640,270 | A * | 8/1927 | Russell | B64D 10/00 128/DIG. 20 |
| 4,498,199 | A * | 2/1985 | Margolis | A63H 3/003 446/28 |
| 6,922,848 | B1 * | 8/2005 | Stanley | A41D 1/00 2/244 |
| 2006/0048291 | A1 * | 3/2006 | Sims | A41D 13/02 2/456 |
| 2009/0272337 | A1 | 11/2009 | Pomponio | |
| 2018/0348862 | A1 * | 12/2018 | Weston | A41D 27/08 |
| 2020/0154671 | A1 | 5/2020 | Chen | |
| 2022/0312861 | A1 | 10/2022 | Ayoubi | |

* cited by examiner

*Primary Examiner* — Kien T Nguyen
(74) *Attorney, Agent, or Firm* — Zhigang Ma

(57) ABSTRACT

The present disclosure provides an inflatable costume. The inflatable costume includes a main body and an elastic inner sleeve. The main body includes a head part and a body part. The head part is provided with a first opening. The elastic inner sleeve is connected to the head part, and is configured to adapt to heads with different sizes. Through the above structure, when a user puts on the inflatable costume, the face of the user can be exposed due to the arrangement of the first opening. Furthermore, as the elastic inner sleeve has elasticity, the elastic inner sleeve can be adjusted according to the size of the head of the user, which avoids the tension that may be caused by a traditional fixed design, so that the inflatable costume is more universal and practical, and the user experience is greatly improved.

19 Claims, 5 Drawing Sheets

INFLATABLE COSTUME

CROSS-REFERENCE TO RELATED APPLICATIONS

The application claims priority of Chinese patent application 2024200269407, filed on Jan. 5, 2024, which is incorporated herein by reference in its entireties.

TECHNICAL FIELD

The present disclosure relates to the field of inflatable costumes, and in particular, to an inflatable costume.

BACKGROUND

In today's entertainment culture, the rise of festival celebrations and theme activities provides a unique stage for the application of inflatable doll costumes. For example, Halloween attracts thousands of children and adults to participate in the celebration in various creative looks. In this happy festival, inflatable doll costumes have become one of the favorite outfits for children due to their exaggerated and funny appearances.

However, with the continuous pursuit of the user experience, the existing inflatable costumes have certain inconvenience. For example, if a user puts on the inflatable costume, because the head part of the costume does not have an appropriate size, the user will not fit into the inflatable costume or the inflatable costume will easily slide off when the user walks around.

To this end, the present disclosure provides an inflatable costume to improve the applicability and user experience of the inflatable costume.

SUMMARY

In order to overcome the shortcomings of the prior art, the present disclosure provides an inflatable costume. The inflatable costume to improve the applicability and user experience of the inflatable costume.

The technical solution adopted by the present disclosure to solve the technical problem is as follows.

The present disclosure provides an inflatable costume, including a main body, wherein the main body includes a head part and a body part, and the head part is provided with a first opening; and an elastic inner sleeve, wherein the elastic inner sleeve is connected to the head part and is configured to adapt to heads with different sizes.

As the improvement of the present disclosure, the head part has a first inflation chamber; the body part has a second inflation chamber; the first inflation chamber is communicated to the second inflation chamber; and the first opening is communicated to the first inflation chamber and the second inflation chamber.

As the improvement of the present disclosure, the elastic inner sleeve has a second opening, a first accommodating chamber, and a third opening; the second opening and the third opening are communicated to the first accommodating chamber; the second opening is communicated to the first opening; and the first accommodating chamber is communicated to the first inflation chamber and the second inflation chamber.

As the improvement of the present disclosure, the elastic inner sleeve is provided with a first elastic band; and the first elastic band is configured to adjust a size of the elastic inner sleeve.

As the improvement of the present disclosure, n the elastic inner sleeve is provided with a first flexible sleeve at a position close to the third opening, and the first elastic band is at least partially located inside the first flexible sleeve.

As the improvement of the present disclosure, an elastic strainer is also arranged on the first elastic band; when the elastic strainer is pressed, a length of the first elastic band located inside the first flexible sleeve is adjusted; and when the elastic strainer is released, the first elastic band is fixed to compress the first flexible sleeve.

As the improvement of the present disclosure, the inflatable costume further includes an air blasting component, wherein the air blasting component is detachably connected to the main body; and the air blasting component is configured to inflate the head part and the body part to fill the first inflation chamber and the second inflation chamber with air.

As the improvement of the present disclosure, the air blasting component includes an air blasting housing; the air blasting housing has an air inlet mesh, an air guide chamber, and an air outlet; the air inlet mesh, the air guide chamber, and the air outlet are communicated to each other in sequence; a motor and a wind wheel are arranged in the air guide chamber; the wind wheel is mounted on an output shaft of the motor; and the air inlet mesh is coaxial with the motor.

As the improvement of the present disclosure, the air blasting component further includes a mesh pressing component; the mesh pressing component is annularly arranged on an outer side of the air inlet mesh; the main body is provided with a mounting port adapting to be assembled with the mesh pressing component; and the mesh pressing component is configured to assemble and connect the air blasting component with the main body.

As the improvement of the present disclosure, the mesh pressing component includes a rotary ring for mesh pressing and a fixed ring; the rotary ring for mesh pressing is detachably screwed onto the fixed ring; and the fixed ring is fixedly arranged at a periphery of the air inlet mesh.

As the improvement of the present disclosure, the inflatable costume further includes a charging component, wherein the charging component is electrically connected to the air blasting component; and the charging component is configured to supply power to the air blasting component.

As the improvement of the present disclosure, the main body is connected to a storage bag; the storage bag is located in the second inflation chamber; the storage bag has a storage chamber and a storage opening; the storage opening is communicated to the storage chamber; and the storage chamber is configured to place the charging component.

As the improvement of the present disclosure, the charging component includes a charging housing and a battery; the battery is detachably mounted in the charging housing; and the charging housing is provided with a charging interface and an on/off button.

As the improvement of the present disclosure, an outer wall of the charging housing is further connected to an elastic buckle; and the charging component is compressed and fixed inside the storage chamber through the elastic buckle.

As the improvement of the present disclosure, the main body is further provided with a zipper device; and the zipper device is located on the body part.

As the improvement of the present disclosure, the body part includes two symmetrical arm parts, and the two arm parts are each provided with a fourth opening for a hand to extend out.

As the improvement of the present disclosure, the two arm parts are respectively provided with second flexible sleeves at positions close to the fourth openings, and second elastic bands are arranged inside the second flexible sleeves.

As the improvement of the present disclosure, the body part further includes two symmetrical leg parts; and lower ends of the two leg parts are each provided with a fifth opening for a foot to extend out.

As the improvement of the present disclosure, the two leg parts are respectively provided with third flexible sleeves at positions close to the fifth openings, and third elastic bands are arranged inside the third flexible sleeves.

As the improvement of the present disclosure, the main body is made of a polyester fiber material; and the elastic inner sleeve is made of an elastic fabric.

The present disclosure has the following beneficial effects. The present disclosure provides an inflatable costume. The inflatable costume includes a main body and an elastic inner sleeve. The main body includes a head part and a body part. The head part is provided with a first opening. The elastic inner sleeve is connected to the head part, and is configured to adapt to heads with different sizes. Through the above structure, when a user puts on the inflatable costume, the face of the user can be exposed due to the arrangement of the first opening. Furthermore, as the elastic inner sleeve has elasticity, the elastic inner sleeve can be adjusted according to the size of the head of the user, which avoids the tension that may be caused by a traditional fixed design, so that the inflatable costume is more universal and practical, and the user experience is greatly improved.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
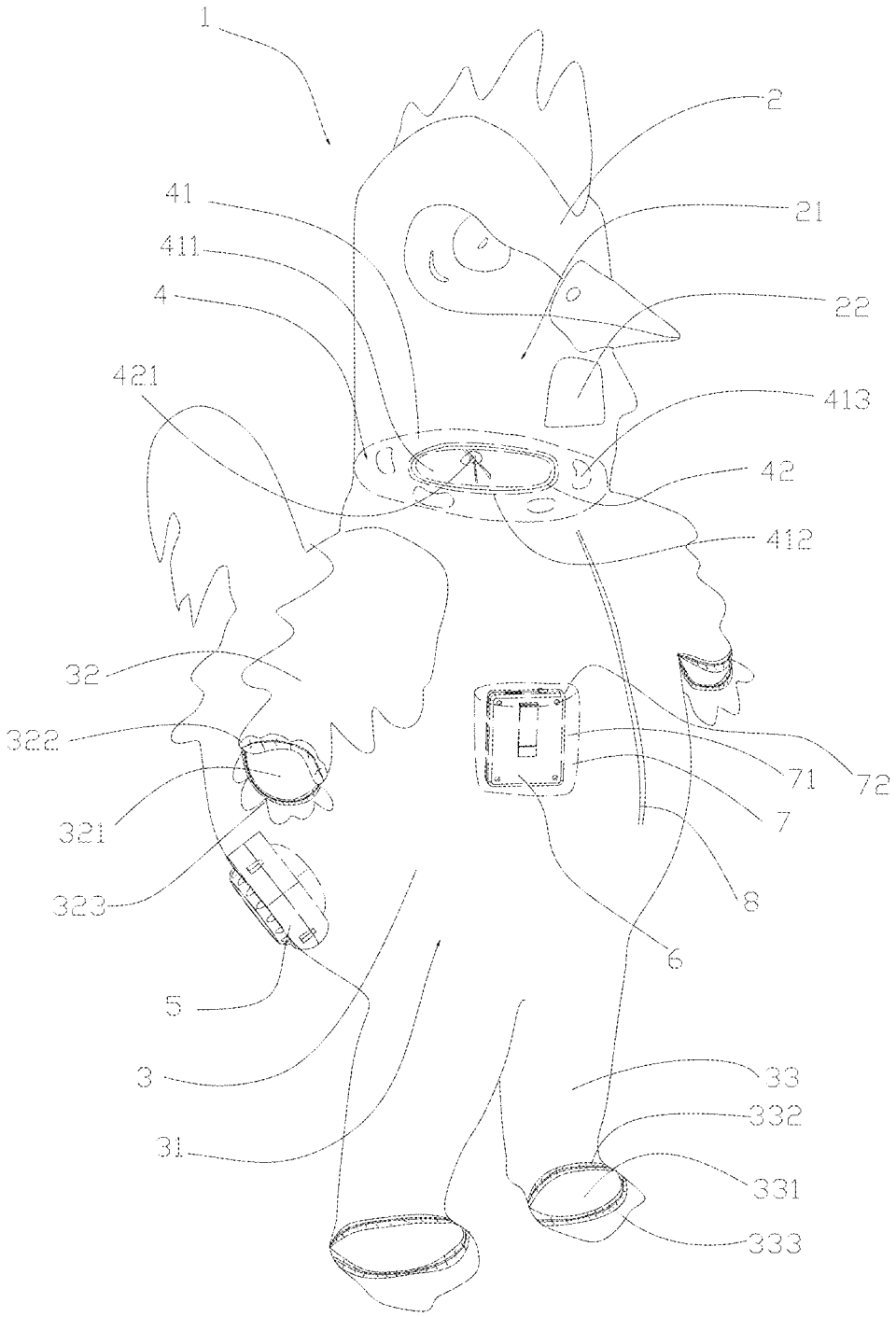
FIG. 1 is a schematic diagram of an entire structure of the present disclosure.
Figure 2:
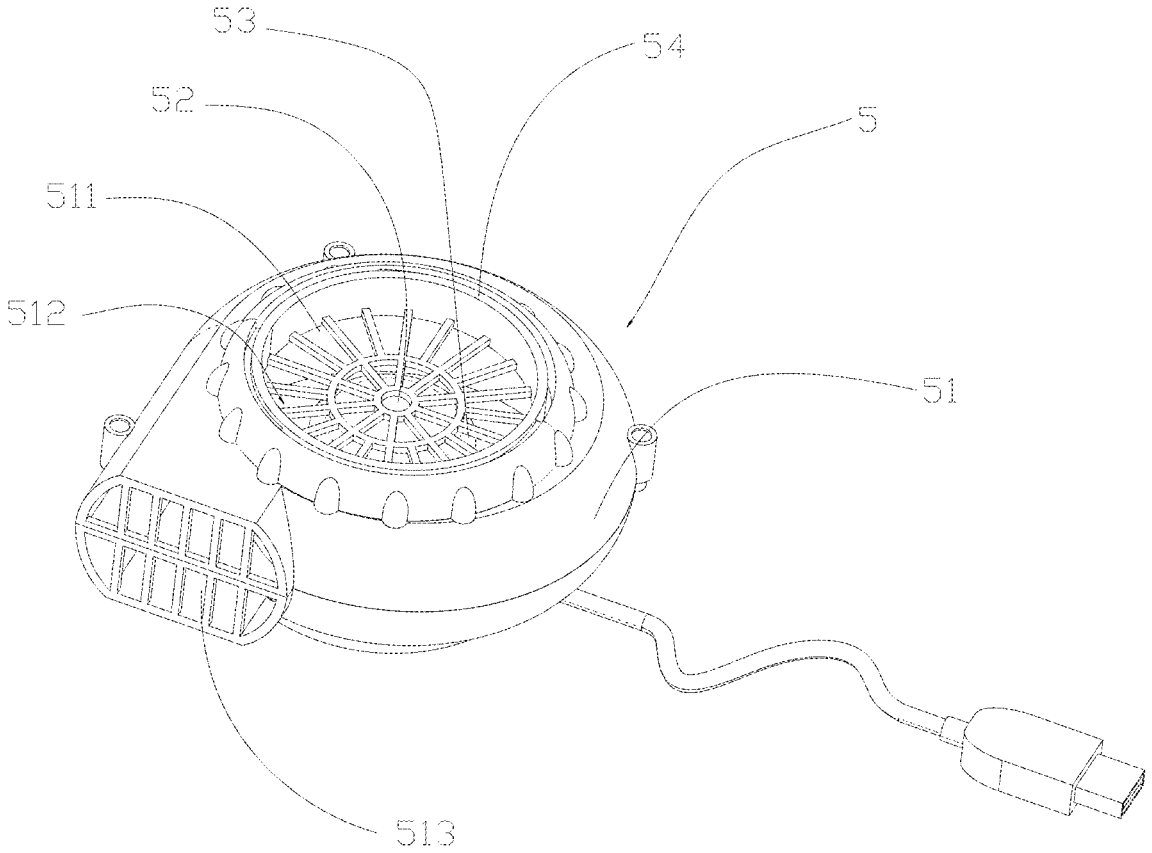
FIG. 2 is cross-sectional view of the present disclosure.
Figure 3:
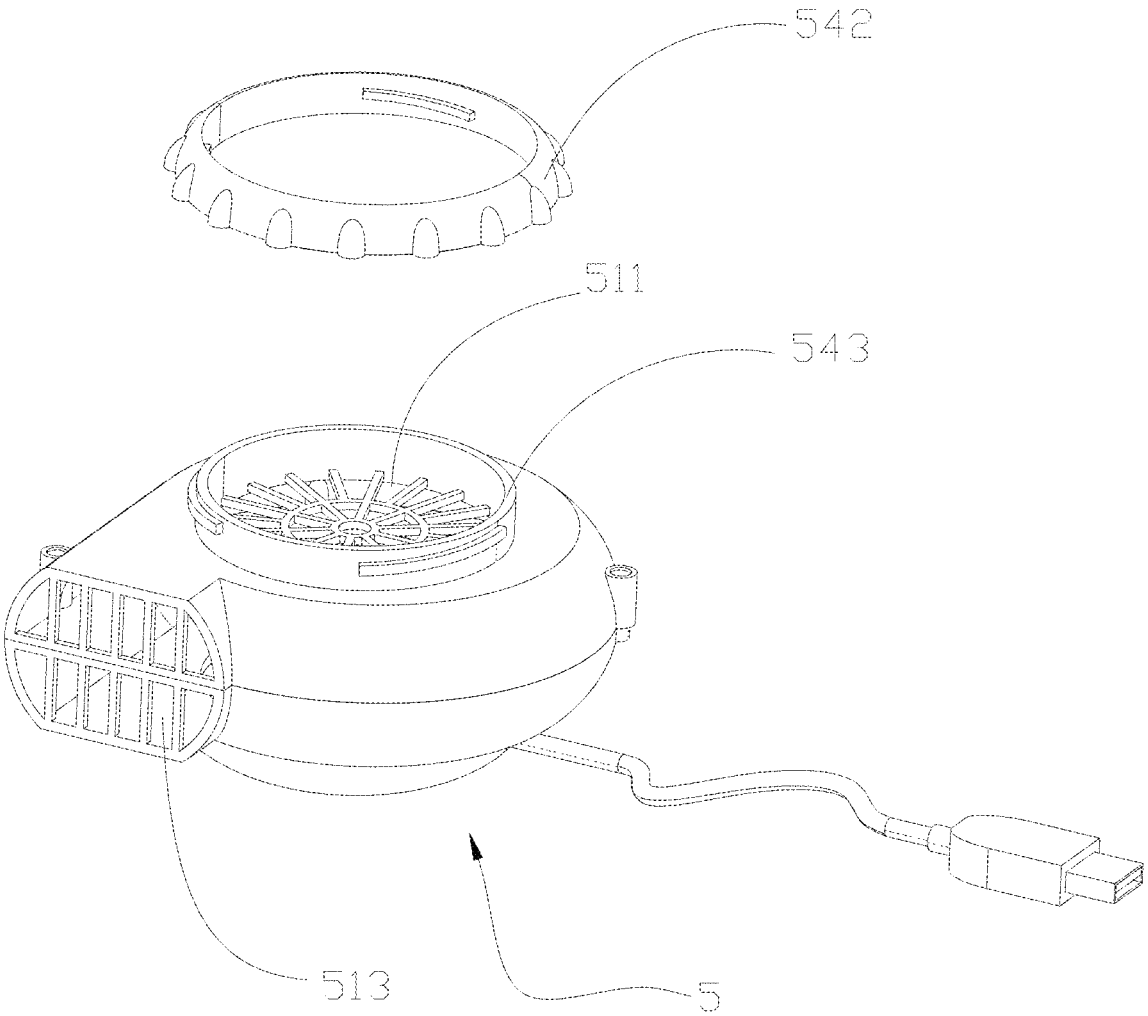
FIG. 3 is a schematic diagram of an air blasting component according to the present disclosure.
Figure 4:
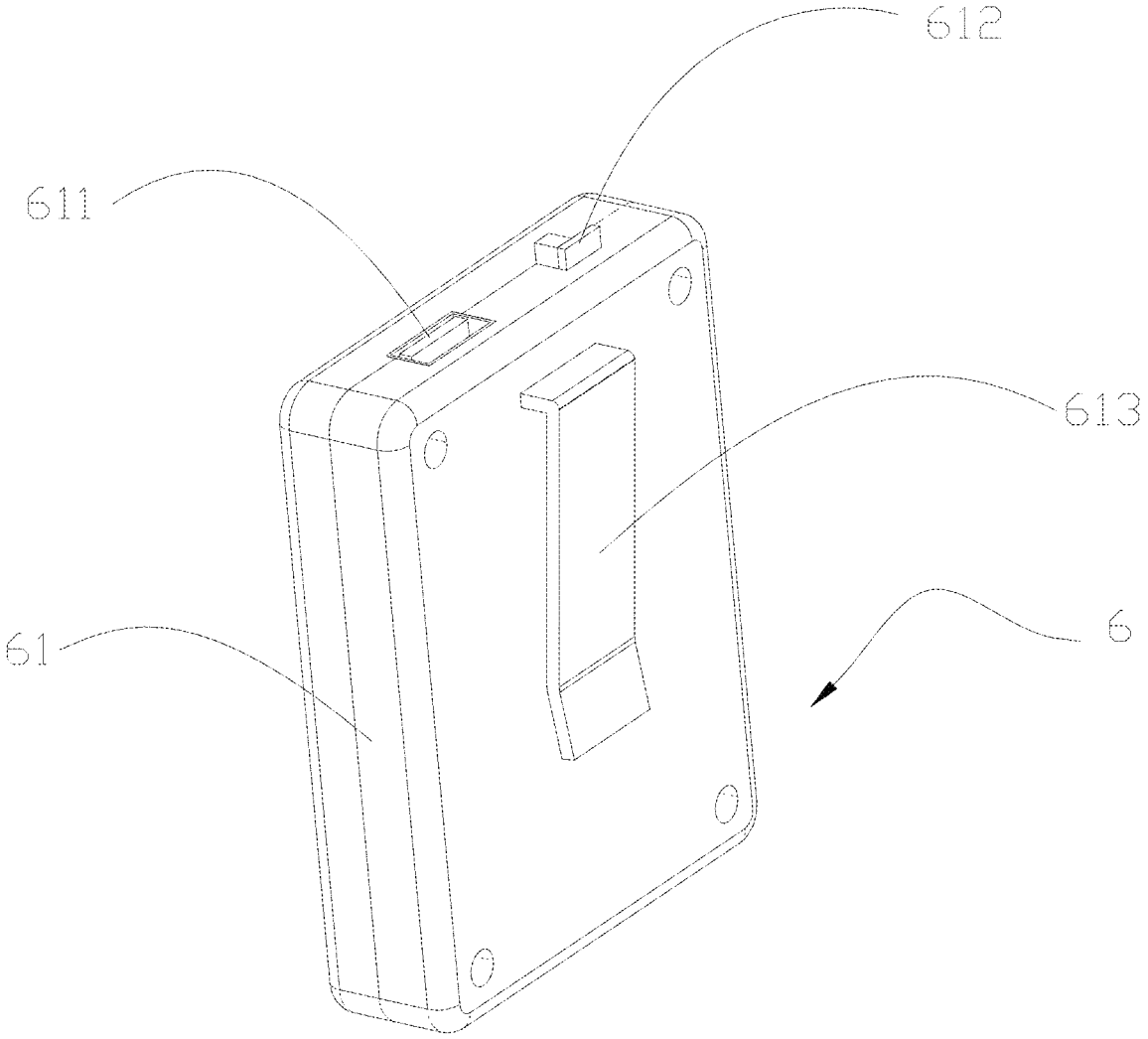
FIG. 4 is an exploded diagram of an air blasting component according to the present disclosure.
Figure 5:
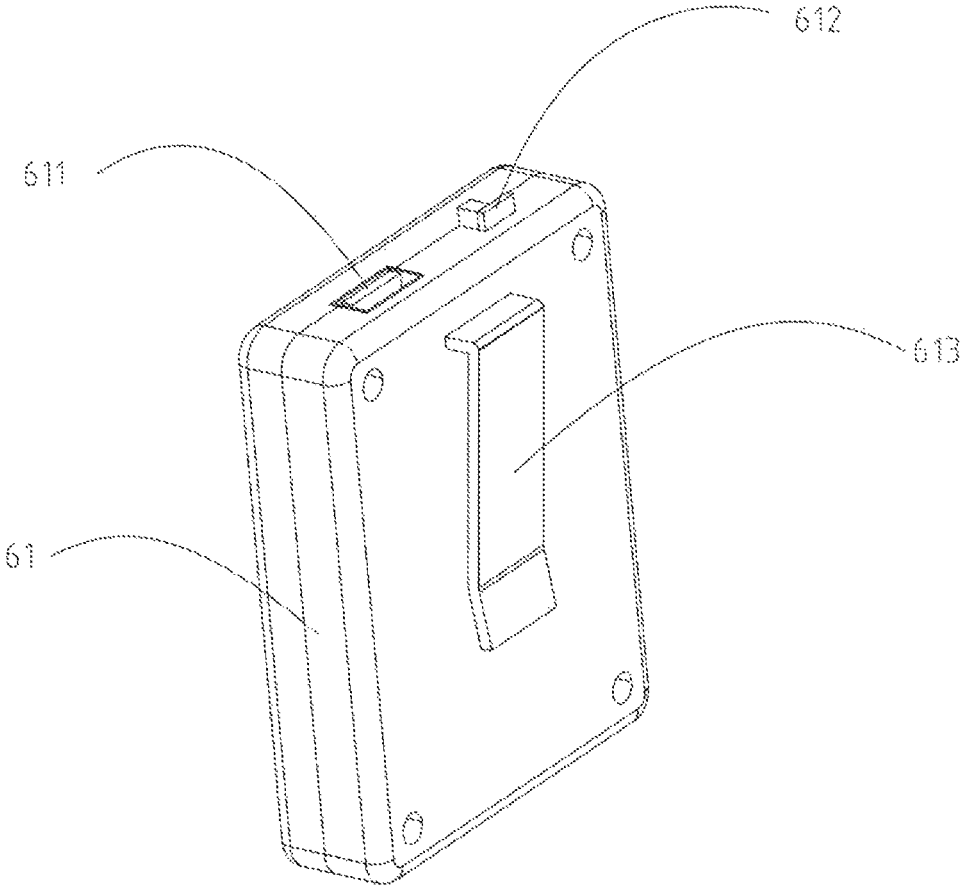
FIG. 5 is a schematic diagram of a charging component according to the present disclosure.

Referring to FIG. 1 to FIG. 5, an inflatable costume includes a main body 1. The main body 1 includes a head part 2 and a body part 3, wherein the head part 2 is provided with a first opening 21; and an elastic inner sleeve 4. The elastic inner sleeve 4 is connected to the head part 2, and is configured to adapt to heads with different sizes. Through the above structure, when a user puts on the inflatable costume, the face of the user can be exposed due to the arrangement of the first opening 21. Furthermore, as the elastic inner sleeve 4 has elasticity, the elastic inner sleeve can be adjusted according to the size of the head of the user, which avoids the tension that may be caused by a traditional fixed design, so that the inflatable costume is more universal and practical, and the user experience is greatly improved.

In this embodiment, the head part 2 has a first inflation chamber 22; the body part 3 has a second inflation chamber 31; the first inflation chamber 22 is communicated to the second inflation chamber 31; and the first opening 21 is communicated to the first inflation chamber 22 and the second inflation chamber 31. The elastic inner sleeve 4 has a second opening 41, a first accommodating chamber 42, and a third opening 43; the second opening 41 and the third opening 43 are communicated to the first accommodating chamber 42; the second opening 41 is communicated to the first opening 21; and the first accommodating chamber 42 is communicated to the first inflation chamber 22 and the second inflation chamber 31. Through the above structure, the user can put the entire body into the first inflation chamber 22 and the second inflation chamber 31. The head of the user passes through the third opening 43 and is sleeved with the first accommodating chamber 42. The face is exposed through the second opening 41 and the first opening 21. This effectively achieves that the user talks to other people easily and conveniently, and improves the comfort and personalized design of the inflatable costume.

In this embodiment, the elastic inner sleeve 4 is provided with a first elastic band 44; and the first elastic band 44 is configured to adjust a size of the elastic inner sleeve 4. Specifically, the elastic inner sleeve 4 is provided with a first flexible sleeve 441 at a position close to the third opening 43, and the first elastic band 44 is at least partially located inside the first flexible sleeve 441. An elastic strainer 442 is also arranged on the first elastic band 44; when the elastic strainer 442 is pressed, a length of the first elastic band 44 located inside the first flexible sleeve 441 can be adjusted; and when the elastic strainer 442 is released, the first elastic band 44 can be fixed to compress the first flexible sleeve 441. Through the above structure, using the elastic band can ensure that the user wears the inflatable costume more firmly, which prevents sliding or displacement of the inner sleeve during movement of the head, and provide a more stable wearing experience. The elastic band with the elastic strainer 442 increases the adjustability of the elastic inner sleeve, so that the user can adjust the tightness of the head more accurately, which provides a more personalized wearing experience.

In this embodiment, the inflatable costume further includes an air blasting component 5, wherein the air blasting component 5 is detachably connected to the main body 1; and the air blasting component 5 is configured to inflate the head part 2 and the body part 3 to fill the first inflation chamber 22 and the second inflation chamber 31 with air. The air blasting component 5 includes an air blasting housing 51; the air blasting housing 51 has an air inlet mesh 511, an air guide chamber 512, and an air outlet 513; the air inlet mesh 511, the air guide chamber 512, and the air outlet 513 are communicated to each other in sequence; a motor 52 and a wind wheel 53 are arranged in the air guide chamber 512; the wind wheel 53 is mounted on an output shaft of the motor 52; and the air inlet mesh 511 is coaxial with the motor 52. Through the above structure, the air blasting component 5 can inflate the main body 1 through the rotation of the motor 52 and the rotation of the wind wheel 53, which can quickly fill the inflatable costume with air and make the inflatable costume rapidly expand. This gives the inflatable costume an exaggerated and vivid appearance and can maintain the shape and predetermined appearance of the inflatable costume.

Further, the air blasting component 5 further includes a mesh pressing component 54; the mesh pressing component 54 is annularly arranged on an outer side of the air inlet mesh 511; the main body 1 is provided with a mounting port 541 adapting to be assembled with the mesh pressing component 54; and the mesh pressing component 54 is configured to assemble and connect the air blasting component 5 with the main body 1. The mesh pressing component 54 includes a rotary ring 542 for mesh pressing and a fixed ring 543; the rotary ring 542 for mesh pressing is detachably screwed onto the fixed ring 543; and the fixed ring 543 is fixedly arranged at a periphery of the air inlet mesh 511. Through the above structure, the fixed ring 543 passes through the mounting port 541, and the rotary ring 542 for mesh pressing is rotatably screwed. At this time, the air blasting component 5 can be fixed on the main body 1 and placed in the second inflation chamber 31, to play a role of the air blasting component 5. This avoids sun and rain and prolongs the service life of the air blasting component 5.

In this embodiment, the inflatable costume further includes a charging component 6, wherein the charging component 6 is electrically connected to the air blasting component 5; and the charging component 6 is configured to supply power to the air blasting component 5. The main body 1 is connected to a storage bag 7; the storage bag 7 is located in the second inflation chamber 31; the storage bag 7 has a storage chamber 71 and a storage opening 72; the storage opening 72 is communicated to the storage chamber 71; and the storage chamber 71 is configured to place the charging component 6. The charging component 6 includes a charging housing 61 and a battery; the battery is detachably mounted in the charging housing 61; and the charging housing 61 is provided with a charging interface 611 and an on/off button 612. An outer wall of the charging housing 61 is further connected to an elastic buckle 613; and the charging component 6 can be compressed and fixed inside the storage chamber 71 through the elastic buckle 613. Through the above structure, the charging component 6 is placed in the storage bag 7 and is then electrically connected to the air blasting component 5 through a universal serial bus (USB) or another connecting wire to supply the power to the air blasting component 5, so that the charging component 6 can supply stable and continuous power to the air blasting component 5, ensuring that the inflatable costume is kept in a continuous inflation state during use. This helps the user to wear the inflatable costume for a long time. Especially when the user participates in various activities or celebrations, the comfort of the user and the convenience of use are improved. Due to the elastic buckle 613, the charging component 6 is placed in the inflatable costume more securely and will not fall off due to big movements.

In this embodiment, the main body 1 is further provided with a zipper device 8; and the zipper device 8 is located on the body part 3. The body part 3 includes two symmetrical arm parts 32, and the two arm parts 32 are each provided with a fourth opening 321 for a hand to extend out. The two arm parts 32 are respectively provided with second flexible sleeves 322 at positions close to the fourth openings 321, and second elastic bands 323 are arranged inside the second flexible sleeves 322. Through the above structure, due to the arrangement of the fourth openings 321 on the two arm parts 32, the hands can be exposed when the user wears the inflatable costume. This helps the user to perform various operations more easily, such as picking up objects and playing games. This makes the inflatable costume more practical in various situations. Moreover, due to the arrangement of the second elastic bands 323, sliding or displacement of the inflatable costume in activities is prevented, which helps to maintain the overall appearance and comfort of the inflatable costume.

In this embodiment, the body part 3 further includes two symmetrical leg parts 33; and lower ends of the two leg parts 33 are each provided with a fifth opening 331 for a foot to extend out. The two leg parts 33 are respectively provided with third flexible sleeves 332 at positions close to the fifth openings 331, and third elastic bands 333 are arranged inside the third flexible sleeves 332. Through the above structure, the feet are allowed to be exposed, so that the user can select different types of shoes to match the inflatable costume, which further personalizes the overall design, provides the user with more choices, and increases the fun and flexibility of the inflatable costume. Moreover, due to the arrangement of the third elastic bands 333, sliding or displacement of the inflatable costume in activities is prevented, which helps to maintain the overall appearance and comfort of the inflatable costume.

In this embodiment, the main body 1 is made of a polyester fiber material; and the elastic inner sleeve 4 is made of an elastic fabric. Through the above structure, a polyester fiber is a lightweight material that makes the inflatable costume lighter and makes a wearer feel more comfortable. In addition, the polyester fiber usually has high wear resistance, which helps to prolong the service life of the inflatable costume.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. An inflatable costume, comprising:

a main body, wherein the main body comprises a head part and a body part; and a tightening device, wherein the tightening device is arranged between the head part and the body part;

wherein the head part has a first inflation chamber; the body part has a second inflation chamber; the first inflation chamber is communicated to the second inflation chamber; and the tightening device is arranged between first inflation chamber and the second inflation chamber.

2. The inflatable costume according to claim 1, wherein the tightening device comprises a barrier layer connected to the main body; the barrier layer has a first opening; and the first inflation chamber, the first opening, and the second inflation chamber are communicated to each other in sequence.

3. The inflatable costume according to claim 2, wherein the barrier layer is provided with a first elastic band; and the first elastic band is configured to adjust a size of the first opening.

4. The inflatable costume according to claim 3, wherein the barrier layer is provided with a first flexible sleeve at a position close to the first opening, and the first elastic band is at least partially located inside the first flexible sleeve.

5. The inflatable costume according to claim 4, wherein an elastic strainer is also arranged on the first elastic band; when the elastic strainer is pressed, a length of the first elastic band located inside the first flexible sleeve is adjusted; and when the elastic strainer is released, the first elastic band is fixed to compress the first flexible sleeve.

6. The inflatable costume according to claim 2, wherein the barrier layer further has at least one air hole; and the first inflation chamber, the air hole, and the second inflation chamber are communicated to each other in sequence.

7. The inflatable costume according to claim 6, wherein the air hole is arranged around the first opening.

8. The inflatable costume according to claim 1, further comprising an air blasting component, wherein the air blasting component is detachably connected to the main body; and the air blasting component is configured to inflate the head part and the body part to fill the first inflation chamber and the second inflation chamber with air.

9. The inflatable costume according to claim 8, wherein the air blasting component comprises an air blasting housing; the air blasting housing has an air inlet mesh, an air guide chamber, and an air outlet; the air inlet mesh, the air guide chamber, and the air outlet are communicated to each other in sequence; a motor and a wind wheel are arranged in the air guide chamber; the wind wheel is mounted on an output shaft of the motor; and the air inlet mesh is coaxial with the motor.

10. The inflatable costume according to claim 9, wherein the air blasting component further comprises a mesh pressing component; the mesh pressing component is annularly arranged on an outer side of the air inlet mesh; the main body is provided with a mounting port adapting to be assembled with the mesh pressing component; and the mesh pressing component is configured to assemble and connect the air blasting component with the main body.

11. The inflatable costume according to claim 10, wherein the mesh pressing component comprises a rotary ring for mesh pressing and a fixed ring; the rotary ring for mesh pressing is detachably screwed onto the fixed ring; and the fixed ring is fixedly arranged at a periphery of the air inlet mesh.

12. The inflatable costume according to claim 8, further comprising a charging component, wherein the charging component is electrically connected to the air blasting component; and the charging component is configured to supply power to the air blasting component.

13. The inflatable costume according to claim 12, wherein the main body is connected to a storage bag; the storage bag is located in the second inflation chamber; the storage bag has a storage chamber and a storage opening; the storage opening is communicated to the storage chamber; and the storage chamber is configured to place the charging component.

14. The inflatable costume according to claim 13, wherein the charging component comprises a charging housing and a battery; the battery is detachably mounted in the charging housing; and the charging housing is provided with a charging interface and an on/off button.

15. The inflatable costume according to claim 14, wherein an outer wall of the charging housing is further connected to an elastic buckle; and the charging component is compressed and fixed inside the storage chamber through the elastic buckle.

16. The inflatable costume according to claim 1, wherein the main body is further provided with a zipper device; the zipper device is arranged on the body part; the head part is further provided with a transparent window; and the transparent window is located at one end close to the tightening device.

17. An inflatable costume, comprising:

a main body, wherein the main body comprises a head part and a body part; and a tightening device, wherein the tightening device is arranged between the head part and the body part;

wherein the body part comprises two symmetrical arm parts; the two arm parts are respectively provided with second openings convenient for the hands to extend out; the two arm parts are respectively provided with second flexible sleeves at positions close to the second openings; and second elastic bands are arranged inside the second flexible sleeves.

18. An inflatable costume, comprising:

a main body, wherein the main body comprises a head part and a body part; and a tightening device, wherein the tightening device is arranged between the head part and the body part;

wherein the body part further comprises two symmetrical leg parts; lower ends of the two leg parts are respectively provided with third openings convenient for the legs to extend out;

the two leg parts are respectively provided with third flexible sleeves at positions close to the third openings; and third elastic bands are arranged in the third flexible sleeves.

19. The inflatable costume according to claim 1, wherein the main body and the tightening device are both made of a polyester fiber material.

* * * * *